US005915603A

United States Patent [19]

Ozeki

[11] Patent Number: 5,915,603

[45] Date of Patent: Jun. 29, 1999

[54] LOOP TURNER

[75] Inventor: Katsuhiko Ozeki, Osaka, Japan

[73] Assignee: Clover Mfg. Co., Ltd., Osaka, Japan

[21] Appl. No.: 08/909,334

[22] Filed: Aug. 11, 1997

[30] Foreign Application Priority Data

Feb. 28, 1997 [JP] Japan ..... 9-045638

[51] Int. Cl.[6] ..... A41H 43/00

[52] U.S. Cl. ..... 223/50; 223/103; 223/41

[58] Field of Search ..... 223/50, 102, 103, 223/42, 41

[56] References Cited

U.S. PATENT DOCUMENTS

| | | | |
|---|---|---|---|
| 597,157 | 3/1898 | May | 223/50 |
| 694,281 | 2/1902 | Hughes | 223/50 |
| 696,185 | 3/1902 | Noyes | 223/50 |
| 705,800 | 7/1902 | Whittemore | 223/50 |
| 1,081,604 | 12/1913 | Gault | 223/50 |
| 4,863,079 | 9/1989 | Holmgren | 223/103 |

*Primary Examiner*—Bibhu Mohanty
*Attorney, Agent, or Firm*—Merchant, Gould, Smith, Edell, Welter & Schmidt, P.A.

[57] ABSTRACT

A loop turner is used for turning a loop member inside out. The loop turner includes a bar body having a front end and a rear end. The bar body is provided with a clip segment for coming into removable engagement with the open mouth edge of the loop member, and a string holding cutout for removably holding a reinforcing string which is inserted through the loop member simultaneously while the loop member is turned inside out.

2 Claims, 14 Drawing Sheets

LOOP TURNER

BACKGROUND OF THE INVENTION

1. Field of the Invention

The present invention relates to a loop turner used for turning a loop member inside out.

The term "loop member" as used herein means any tubular member which has a loop form in cross section. Such a loop member is used as a handle of a bag or as a waist belt for example.

Particularly, the loop turner of the present invention is intended to be used for turning, inside out, a loop member which is prepared by sewing both longitudinal edges of a fabric strip. However, the material of which the loop member is made is not at all limitative.

2. Description of the Related Art

As shown in FIG. 19 of the accompanying drawings, a typical prior art loop turner B1 includes a bar body 70 which has a handle ring 70*a* at a rear end and an engaging hook 71 at a front end. The engaging hook 71 is associated with a needle member 72 which is connected to the bar body 70 for pivotal movement, as indicated by a double-headed arrow Na.

In use of the loop turner B1, the user first holds the handle ring 70*a* and inserts the bar body 70 into a loop member 59 from one open end 59*a* thereof until the engaging hook 71 projects out through the other open end 59*b* of the loop member 59. The loop member 59 may be prepared by sewing both longitudinal edges of a fabric strip together by a sewing yarn m. Thus, the loop member 59 initially has excess fringes 5) exposed outside together with the back surface 58B, whereas the appearance surface 58A of the loop member 59 is initially concealed inside the loop member.

Then, the user causes the needle member 72 to engage the open end 59*b* of the loop member 59 and slightly pulls the bar body 70 for bringing the engaging hook 71 into engagement with the open end 59*b,* as indicated by an arrow Nc in FIG. 19.

Finally, as indicated by an arrow Nb in FIG. 20, the user fully pulls back the bar body 70 for turning the loop member 59 inside out. As a result, the fringes 57 of the loop member 59 are concealed inside, whereas the appearance surface 58A of the loop member 59 is exposed.

However, the prior art loop turner B1 has been found to be disadvantageous in the following points.

First, the prior art loop turner B1 need be pushed into the loop member 59 for engagement and then pull back for turning the loop member 59 inside out. Thus, the loop turner B1 must be moved in two directions, which makes the loop turning operation rather cumbersome and time-taking. Further, the need for engaging the needle member 72 with the open end 59*b* of the loop member 59 renders the loop turning operation even more troublesome.

Secondly, as shown in FIG. 21, if the length L of the loop member 59 is greater than that of the loop turner B1, the loop member 59 must be creased or crimped on the bar body 70 before turning the loop member 59 inside out, and such a crease may deteriorate the appearance of the loop member 59 even after turning inside out. For solution of this problem, it becomes necessary to prepare a plurality of loop turners each having a different length and select a loop turner of a suitable length depending on the particular length of the loop member to be turned inside out, which causes a cost problem.

SUMMARY OF THE INVENTION

It is, therefore, an object of the present invention to provide a loop turner which is capable of turning a loop member inside out simply by a one-way insertion into the loop member.

Another object of the present invention is to provide a loop turner which is capable of simultaneously inserting a reinforcing string through a loop member while turning the loop member inside out.

According to one aspect of the present invention, there is provided a loop turner for turning a loop member inside out, the loop member including an open mouth edge for allowing insertion of the loop turner, the loop turner comprising: a bar body having a front end and a rear end; and a loop retaining means provided on the bar body for coming into removable engagement with the open mouth edge of the loop member at the time of inserting the bar body in one direction through the open mouth edge.

According to the design of the loop turner described above, since the loop retaining means comes into removable engagement with the open mouth edge of the loop member when inserting the bar body into the loop member in one direction. Thus, unlike the prior art loop turner, it is unnecessary to first insert the loop turner completely into the loop member and thereafter pull it back for engagement with the loop member. As a result, the operation of turning the loop member inside out can be greatly facilitated.

Further, since the loop retaining means can be made to engage the open mouth edge of the loop member by partially inserting the bar body into the loop member in one direction and need not be fully inserted for purposes of engagement, the loop turner can be used to turn the loop member inside out even if the loop member is long or short. Thus, it is unnecessary to prepare a plurality of differently sized loop turners for use with respect to loop members of different lengths.

According to a preferred embodiment of the present invention, the loop retaining means comprises an elastically deformable clip segment having a free end and a base end fixed to the bar body. In this case, the open mouth edge of the loop member is clamped between the clip segment and the bar body when the bar body is inserted into the loop member in said one direction.

The clip segment may be integral with the bar body which is made of an elastically deformable material. Alternatively, the clip segment may be prepared separately from the bar body and later attached thereto.

Preferably, the loop retaining means may comprise, in combination, a loop holding cutout formed in the bar body and an elastically deformable clip segment disposed at the loop holding cutout. Typically, the loop holding cutout may include a pair of slits flanking the clip segment for facilitating elastic movement thereof.

The free end of the clip segment may be toothed or sharpened for reliable engagement with the open mouth edge of the loop member. Alternatively or additionally, the clip segment may have a pair of toothed side edges.

Advantageously, the free end of the clip segment may be tapered to have a wall thickness which progressively reduces toward the front end of the bar body. Similarly, the loop holding cutout may also have a tapered peripheral edge located in facing relation to the free end of the clip segment, the tapered peripheral edge having a wall thickness which progressively reduces toward the free end of the clip segment.

According to another preferred embodiment of the present invention, the loop retaining means comprises a pair of elastically deformable side clip segments each having a free end and a base end fixed to the bar body. In this case, the open mouth edge of the loop member is clamped between each side clip segment and the bar body by lateral elastic movement of the side clip segment.

The loop retaining means may be located closer to the front end of the bar body than it is to the rear end of the bar body. Alternatively, the loop retaining means may be located closer to the rear end of the bar body than it is to the front end of the bar body.

Preferably, the loop turner may further comprise a string holding means provided on the bar body for removably holding a reinforcing string which is inserted through the loop member simultaneously while the loop member is turned inside out. The string holding means may be in the form of a string holding cutout formed in the bar body between the loop retaining means and the rear end of the bar body.

Further preferably, the string holding cutout may include a wider slot portion and a curved narrower end portion.

According to another aspect of the present invention, there is provided a loop turner for turning a loop member inside out, the loop member including an open mouth edge for allowing insertion of the loop turner, the loop turner comprising: a bar body having a front end and a rear end; a loop retaining means provided on the bar body for coming into removable engagement with the open mouth edge of the loop member; and a string holding means provided on the bar body for removably holding a reinforcing string which is inserted through the loop member simultaneously while the loop member is turned inside out.

Other objects, features and advantages of the present invention will become apparent from the following description of the preferred embodiments given with reference to the accompanying drawings.

DETAILED DESCRIPTION OF THE PREFERRED EMBODIMENTS

Figure 1A:
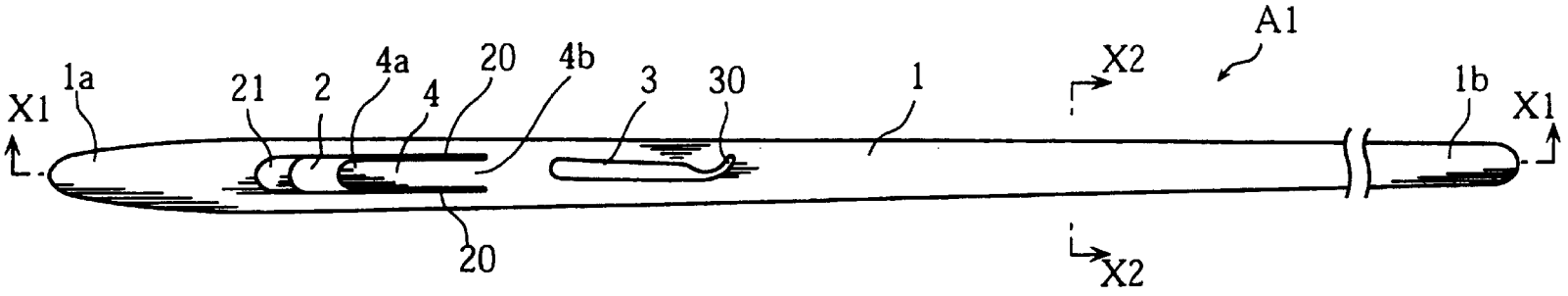
FIG. 1*a* is a plan view showing a loop turner according to a first embodiment of the present invention.
Figure 1B:
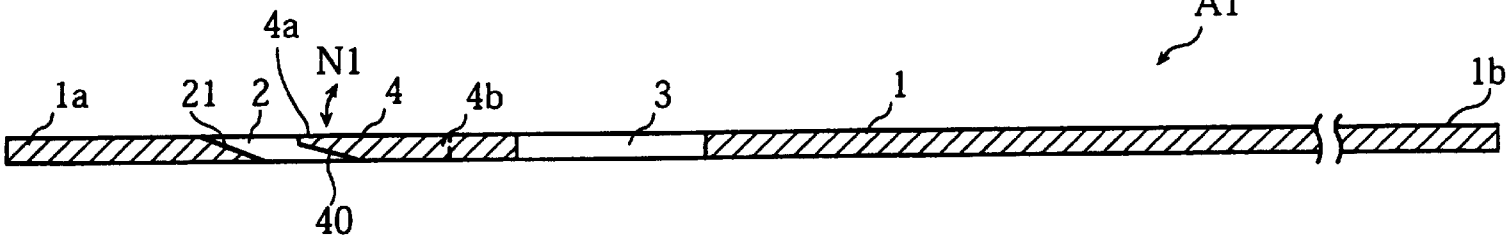
FIG. 1*b* is a sectional view taken along section lines X1—X1 in FIG. 1*a;*
Figure 1C:
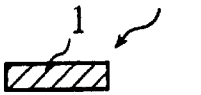
FIG. 1*c* is a sectional view taken along section lines X2—X2 in FIG. 1*a;*

Referring first to FIGS. 1*a* to 1*c* of the accompanying drawings, there is illustrated a loop turner according to a first embodiment of the present invention. The loop turner, generally designated by reference sign A1, includes a bar body 1 of a predetermined length, a loop holding cutout 2 formed in the bar body 1, a string holding cutout 3 also formed in the bar body 1, and a clip segment 4 formed at the the loop holding cutout 2.

The bar body 1 has smooth surfaces and is made of a synthetic resin for example. The bar body 1 may be rectangular in cross section, as shown in FIG. 1*c*. The length of the bar body 1 may be in the range of 20–30 cm for example. The bar body 1 has front and rear ends 1*a*, 1*b* which are smoothly rounded. The width of the bar body 1 is largest at an intermediate portion adjacent to the front end 1*a* and progressively decreases toward the rear end 1*b*.

According to the first embodiment shown in FIGS. 1*a*–1*c*, the loop holding cutout 2 is formed adjacent to the front end of the bar body 1 and fully penetrates the wall thickness of the bar body 1. The loop holding cutout 2 cooperates with the clip segment 4 for holding a loop member (as hereinafter described) and includes a pair of longitudinally extending parallel slits 20 flanking the clip segment 4.

The clip segment 4 is formed at the loop holding cutout 2 to be integral with the bar body 1. The clip segment 4 is the form of an elongated tongue which is elastically flexible, as indicated by a double-headed arrow N1 in FIG. 1*b*. Specifically, the clip member 4 has a free end 4*a* directed toward the front end 1*a* of the bar body 1, and a fixed base end 4*b* for connection to the bar body 1.

As better shown in FIG. 1*b*, the clip member 4 has a tapered underside surface 40 so that the thickness of the clip member 4 decreases progressively toward the free end 4*a*.

Similarly, the loop holding cutout 2 has a front peripheral upper surface 21 which is tapered to face the tapered underside surface 40 of the clip member 4.

The string holding cutout 3 is disposed between the clip segment 4 and the rear end 1*b* of the bar body 1, and fully penetrates the wall thickness of the bar body 1. The string holding cutout 3 is in the form of a slot extending longitudinally of the bar body 1, and has a curved narrower end portion 30. In the first embodiment, the narrower end portion 30 of the string holding cutout 3 is arcuately curved.

The loop turner A1 described above may be used in the following manner for turning a loop member inside out.

Figure 2:
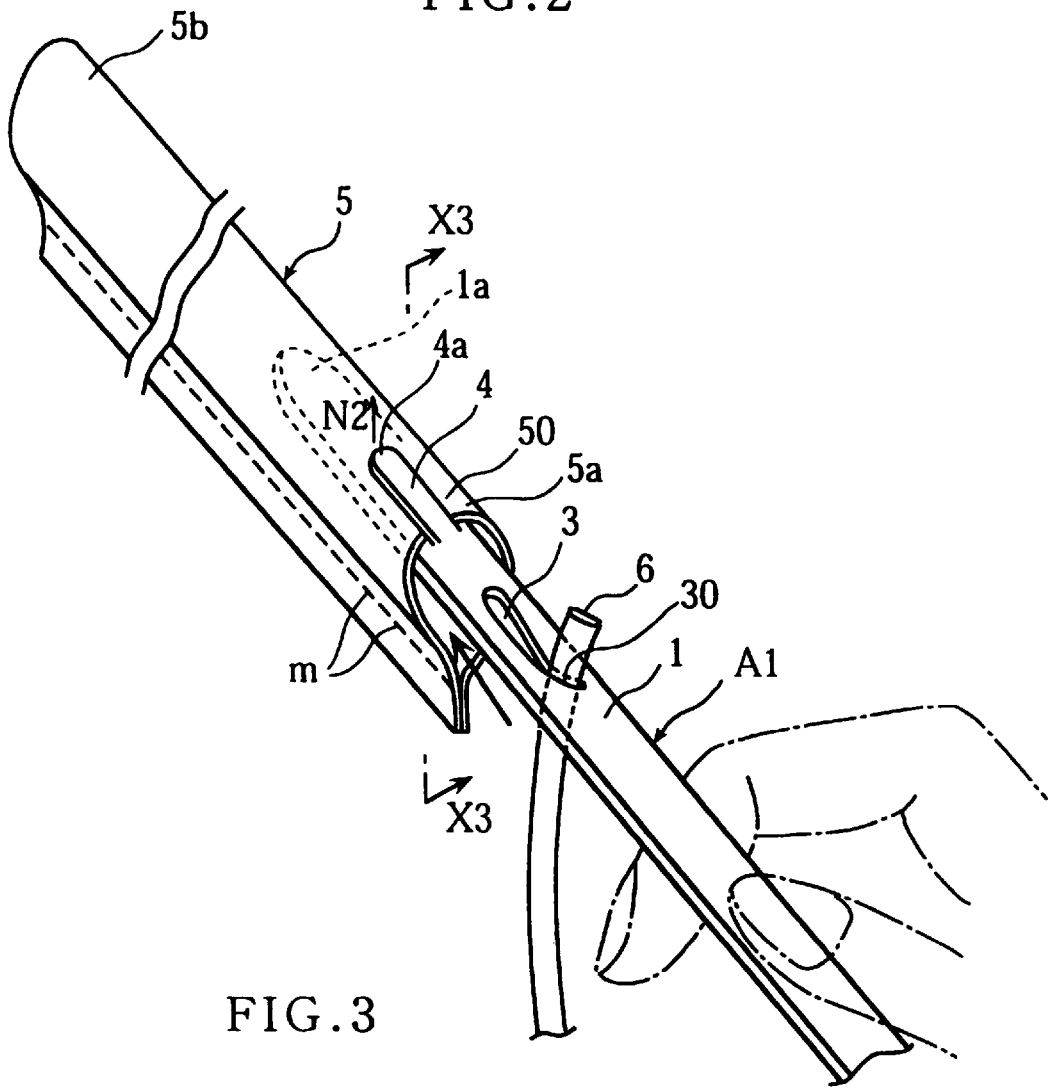
FIG. 2 is a perspective view showing how to use the loop turner for turning a loop member inside out.

As shown in FIG. 2, the loop member designated by reference numeral 5 is tubular (therefore having a loop form in cross section) with a first end 5*a* and a second end 5*b*. The loop member 5 may be prepared, for example, by sewing a fabric strip along both longitudinal edges with a yarn m.

For turning the loop member 5 inside out, a string (or cord or strap) 6 is first inserted into the string holding cutout 3 of the bar body 1 for retention, and the front end 1*a* of the bar body 1 is thereafter inserted into the loop member 5 from the first end 5*a* thereof, as also shown in FIG. 2. At this time, the rounded configuration of the front end 1*a* of the bar body 1 facilitates insertion into the loop member 5. As a result of such insertion, an open mouth edge 50 of the loop member 5 at the first end 5*a* is clamped between the clip segment 4 and the bar body 1 at the loop holding cutout 2, as more specifically described below.

Figure 3:
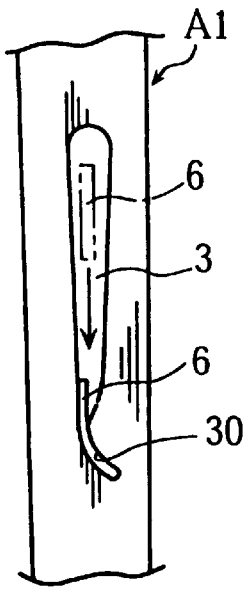
FIG. 3 is a fragmentary plan view showing a string holding cutout of the loop turner.

As shown in FIG. 3, the string 6 may be conveniently retained by first introducing the string 6 into the string holding cutout 3 at a wider portion thereof (see the chain line position), and thereafter moving the string 6 to the curved narrower end portion 30 of the loop holding cutout 3. If the string 6 is made of rubber, fabric or yarn, it deforms to fit to the dimension and configuration of the narrower end portion 30. Further, the elasticity of the resinous bar body 1 and the curved configuration of the narrower end portion 30 assist in reliably retaining the string 6. The string 6 may be utilized as a core for reinforcing the loop member 5. Such reinforcement is particularly advantageous where the loop member 5 is used as a handle of a bag for example.

Figure 4:
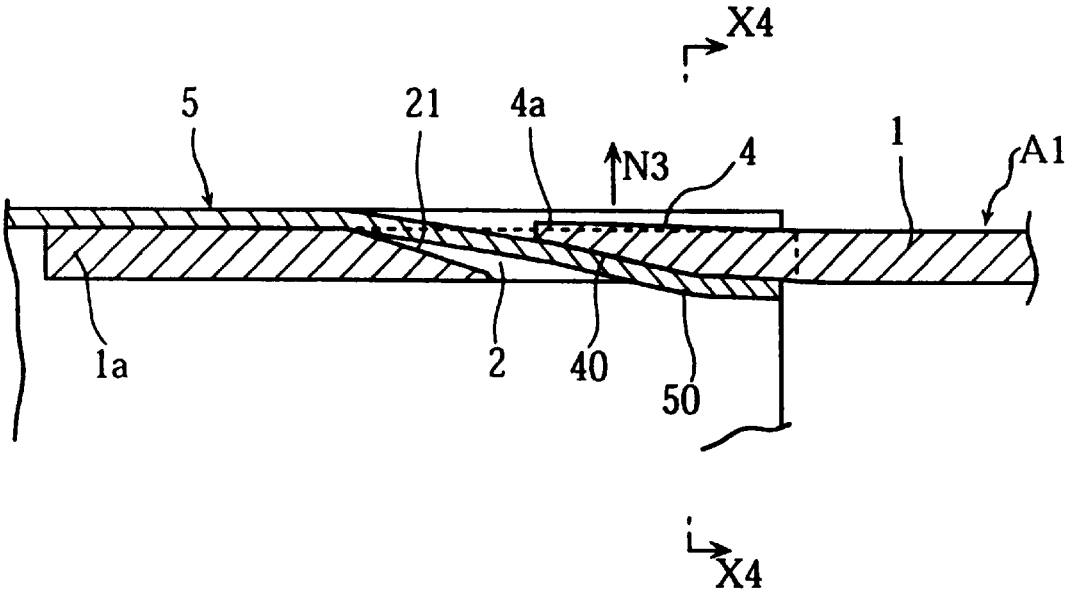
FIG. 4 is a sectional view taken along section lines X3—X3 in FIG. 2.
Figure 5:
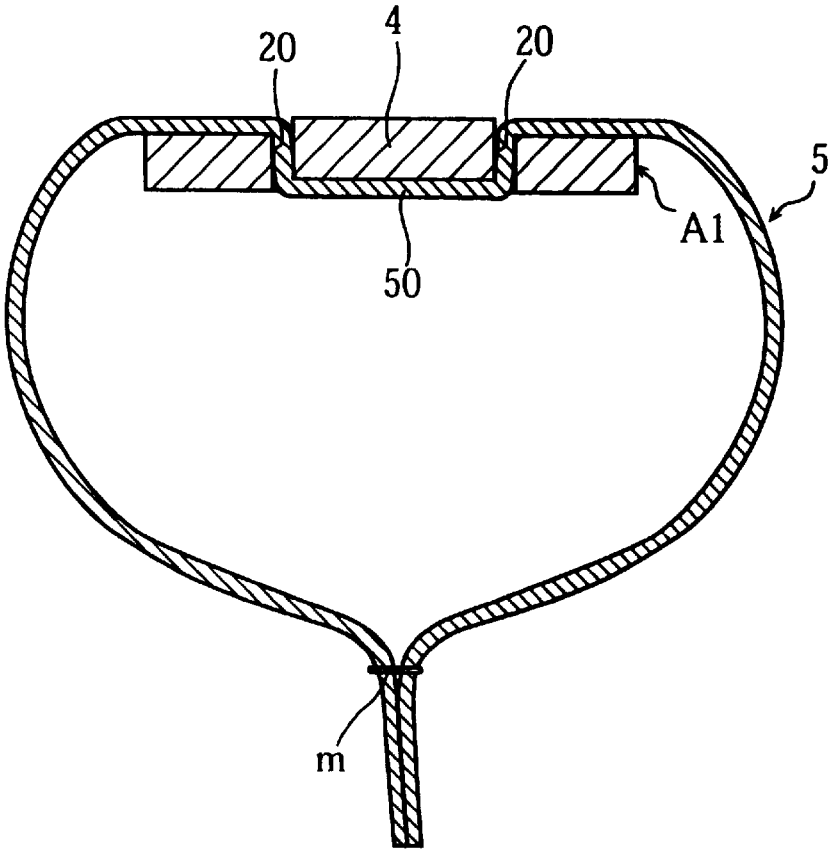
FIG. 5 is a sectional view taken along section lines X4—X4 in FIG. 4.

On the other hand, the manipulation of attaching the bar body 1 to the loop member 5 may be performed by applying an upward force to the front end 1*a* of the bar body 1 after partial insertion into the loop member 5, so that the free end 4*a* of the clip segment 4 is slightly lifted to form a suitable clearance for accepting the open mouth edge 50 of the loop member 5, as indicated by an arrow N2 in FIG. 2. As a result, the open mouth edge 50 of the loop member 5 can be fixedly clamped between the clip segment 4 and the bar body 1 as partially held inserted in the slits 20, as shown in FIGS. 4 and 5. Thus, as long as the bar body 1 is moved further into the loop member 5 (i.e., toward the second end 5*b* of the loop member 5), it is reliably held attached to the loop member 5.

At the time of attaching the bar body 1 to the loop member 5, the tapered underside surface 40 of the clip segment 4 and the tapered peripheral upper surface of the loop holding cutout 2 are advantageous for two reasons. First, the taper configuration facilitates inserting the open mouth edge 50 of the loop member 5 under the clip segment 4. Secondly, the taper configuration prevents or limits the clip segment 4 from being unduly raised due to a reaction of inserting the loop member 5 under the clip segment 4, thereby reducing the likelihood that the clip member 4 is frictionally rubbed against the loop member 5 upon further insertion into the loop member 5 for turning inside out.

Figure 6:
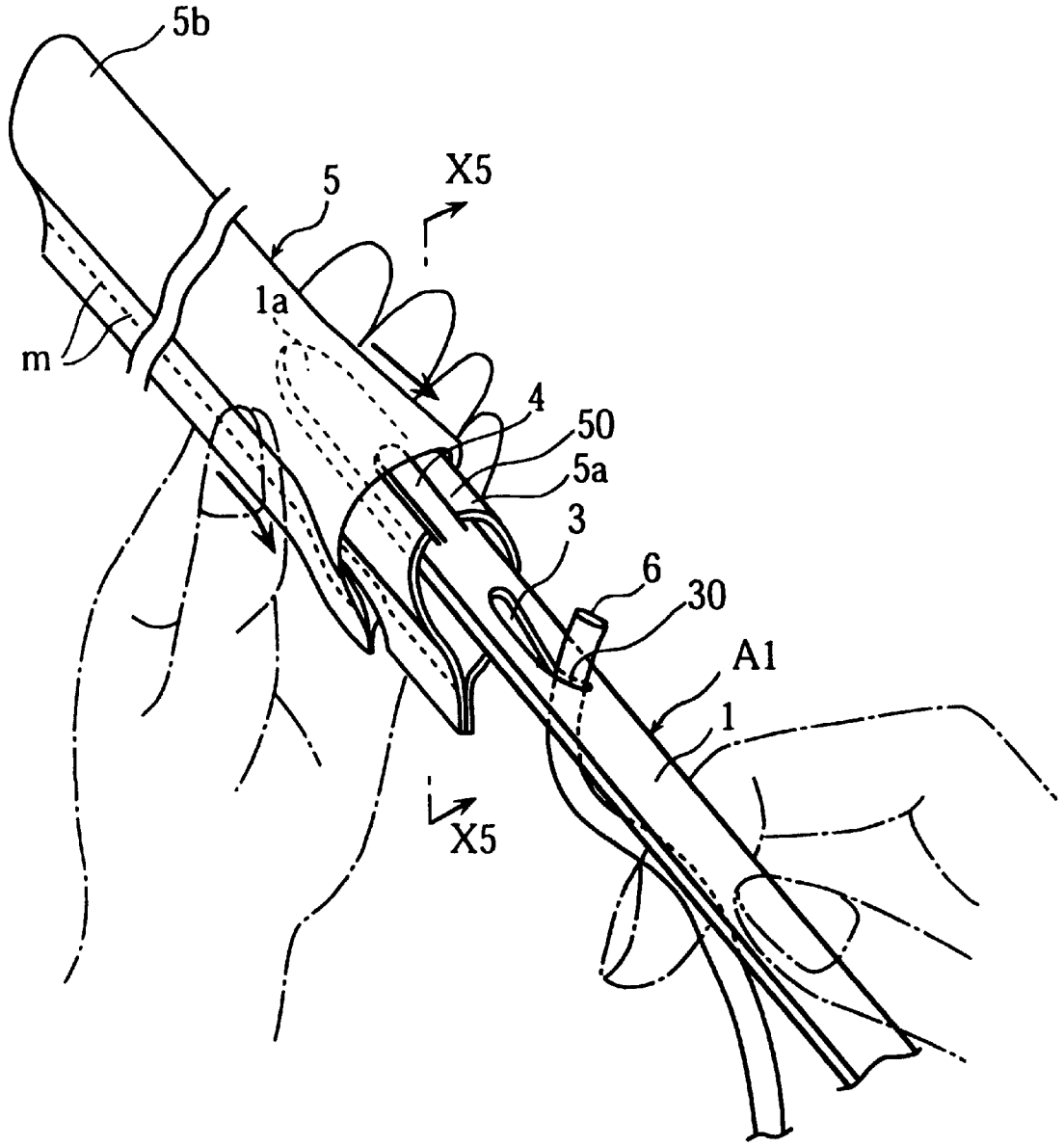
FIG. 6 is a perspective view showing an intermediate stage of turning the loop member inside out.
Figure 7:
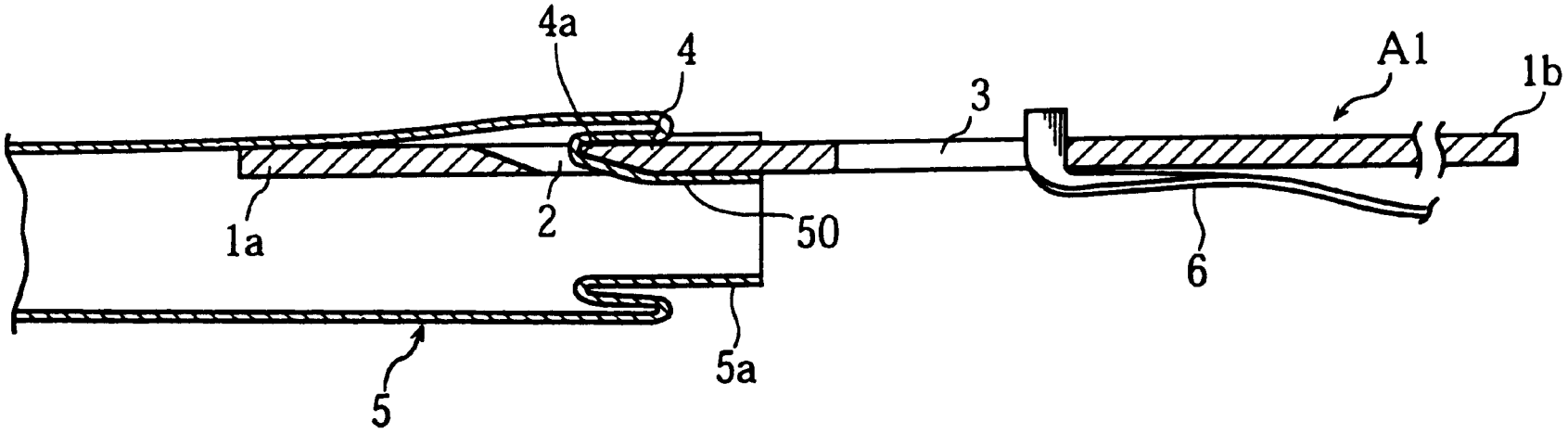
FIG. 7 is a sectional view taken along section lines X5—X5 in FIG. 6.
Figure 8:
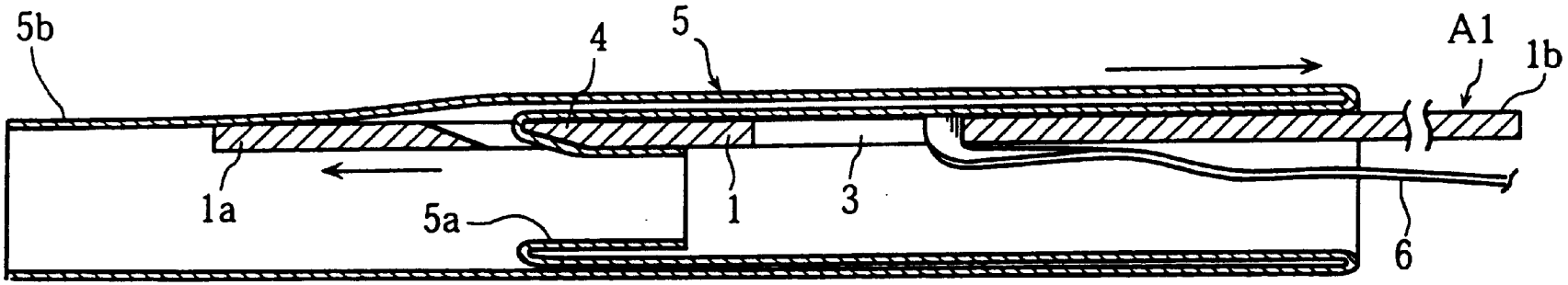
FIG. 8 is a sectional view similar to FIG. 7 but showing another intermediate stage of turning the loop member inside out.

After thus attaching the bar body 1 to the first end 5*a* of the loop member 5, the user grips an intermediate portion of the loop member 5 ahead of the clip segment 4 (i.e., between the clip member 4 and the second end 5*b* of the loop member 5) and pulls the loop member 5 toward the rear end 1*b* of the bar body 1, as shown in FIGS. 6 and 7. Alternatively, the user may push the bar body 1 further into the loop member 5. In either case, the intermediate portion of the loop member 5 need be made to ride over the open mouth edge 50 of the loop member 5 retained by the clip segment 4. As a result, the loop member 5 assumes a transitional state of a double loop or tube, as shown in FIG. 8.

Figure 9:
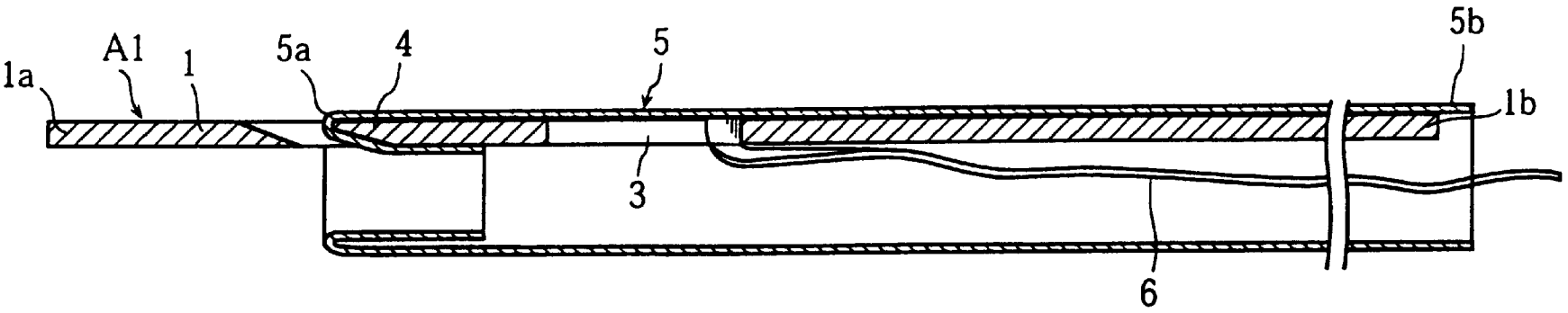
FIG. 9 is a sectional view similar to FIG. 7 but showing a final stage of turning the loop member inside out.

Then, as shown in FIG. 9, the loop member 5 is further pulled toward the rear end 1*b* of the bar body 1 or the bar body 1 is further pushed toward the second end 5*b* of the loop member 5 until the loop member 5 is turned inside out. However, in the state illustrated in FIG. 9, the open mouth edge 50 of the loop member 5 still remains retained by the clip segment 4.

Figure 10:
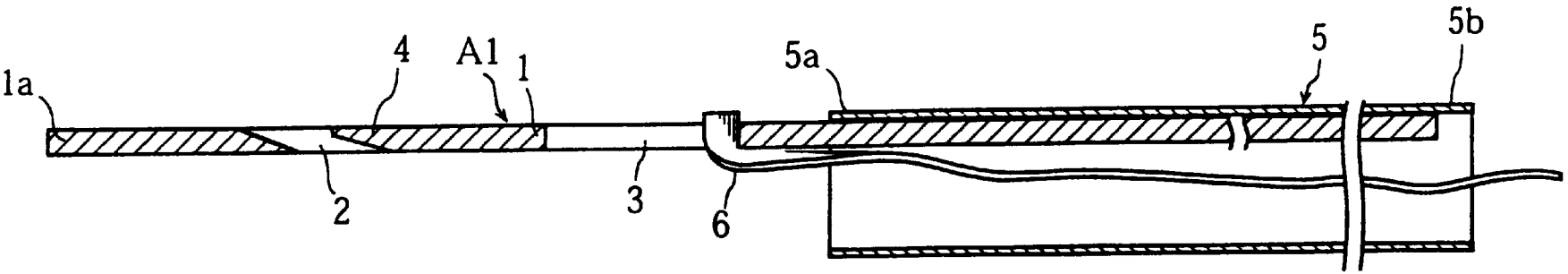
FIG. 10 is a sectional view similar to FIG. 7 but showing a step of removing the loop turner from the loop member.

Then, as shown in FIG. 10, the open mouth edge 50 of the loop member 5 is manually disengaged from the clip segment 4, and the bar body 1 is pulled out through the open mouth edge of the loop member 5 together with the string 6.

Figure 11:
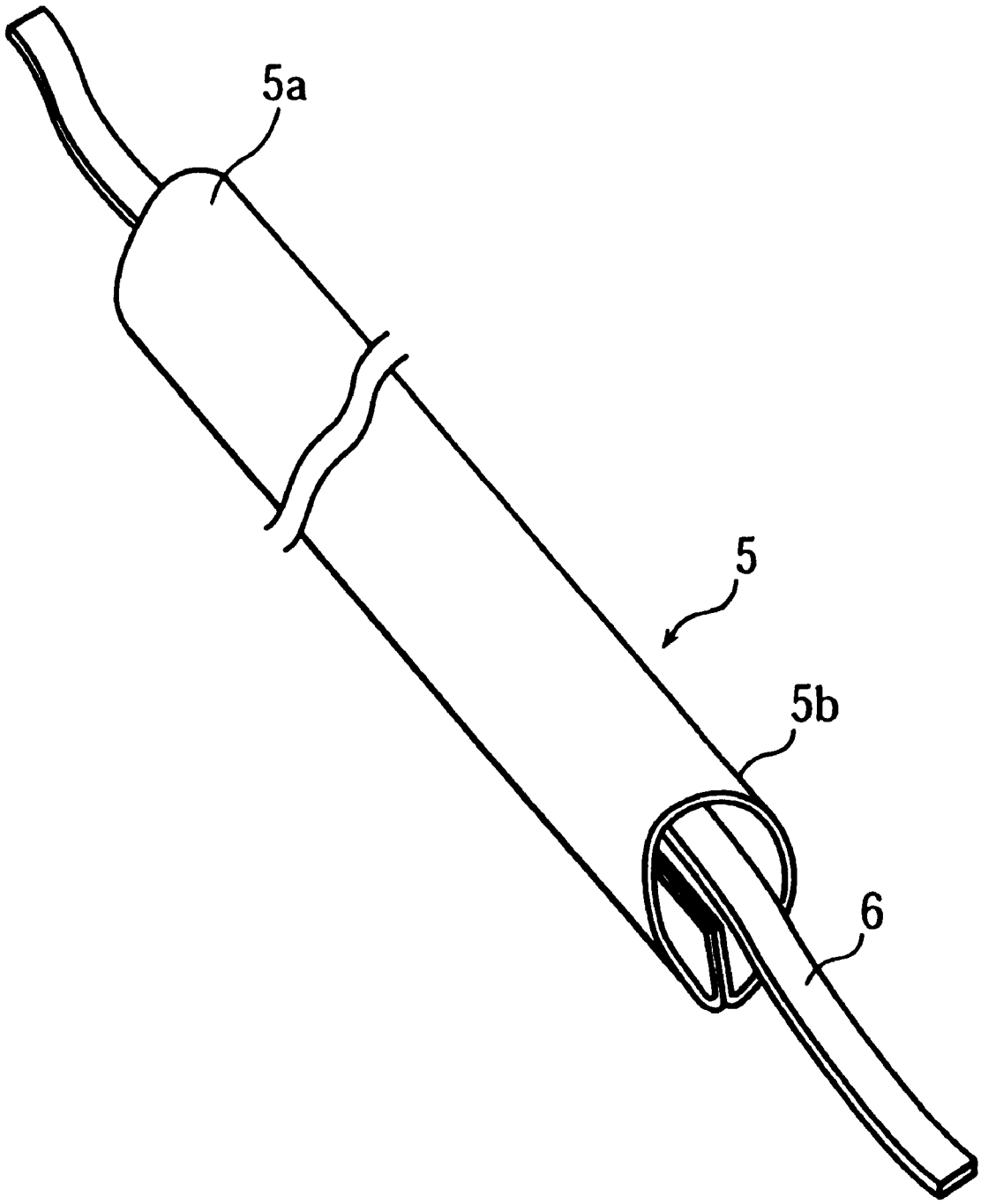
FIG. 11 is a perspective view showing the loop member which has be completely turned inside out with a reinforcing string inserted therethrough.

Finally, the string 6 which have been previously made to pass through the turned loop member 5 is removed from the bar body 1 (namely, from the string holding cutout 3, as shown in FIG. 11.

According to the series of steps described above, the user can turn the loop member 5 inside out with the use of the bar-like loop turner A1 while also inserting the string 6 through the loop member 5. Thus, it is unnecessary to perform a separate step of inserting a string by means of an additional device after turning the loop member 5.

Further, the bar body 1 need only be inserted or moved in one direction for turning the loop member 5 inside out. Thus, it is possible to greatly simplify the steps for turning the loop member 5 inside out while also obviating the need for preparing a plurality of differently sized loop turners for loop members of different lengths.

Figure 12:
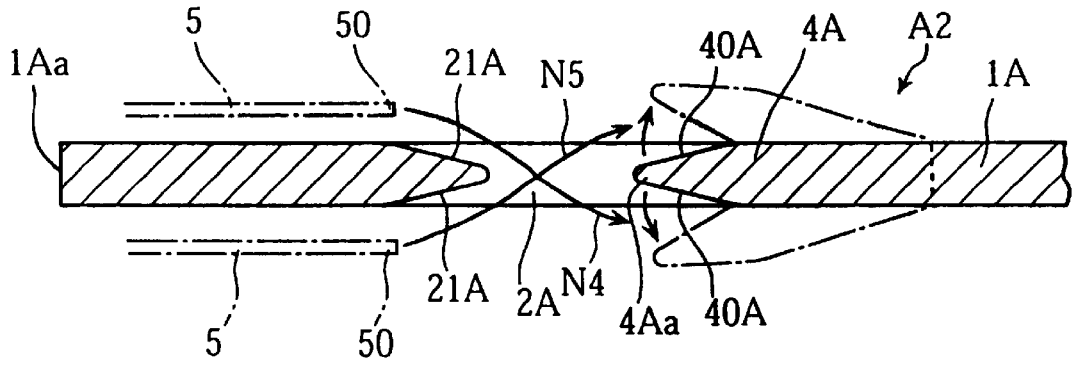
FIG. 12 is a fragmentary view, in longitudinal section, showing a principal portion of a loop turner according to a second embodiment of the present invention.

FIG. 12 illustrates a loop turner A2 according to a second embodiment of the present invention. The loop turner A2 of this embodiment includes a bar body 1A with a loop holding cutout 2A and a clip segment 4A. The clip segment 4A has a free end 4A*a* defined by a vertically spaced pair of tapered surfaces 40A approaching each other toward the front end 1A*a* of the bar body 1A. Similarly, the loop holding cutout 2A has a peripheral edge partially defined by a vertically spaced pair of tapered surfaces 21A approaching each other toward the free end 4A*a* of the clip segment 4A. The loop turner A2 of the second embodiment is otherwise similar to that of the first embodiment.

According to the second embodiment, the open mouth edge 50 of the loop member 5 may be inserted under the clip segment 4A (as indicated by an arrow N4 in FIG. 12) or above the clip segment 4A (as indicated by an arrow N5). Thus, no attention need be paid with respect to the up-down (or head-tail) orientation of the loop turner A2.

Figure 13A:
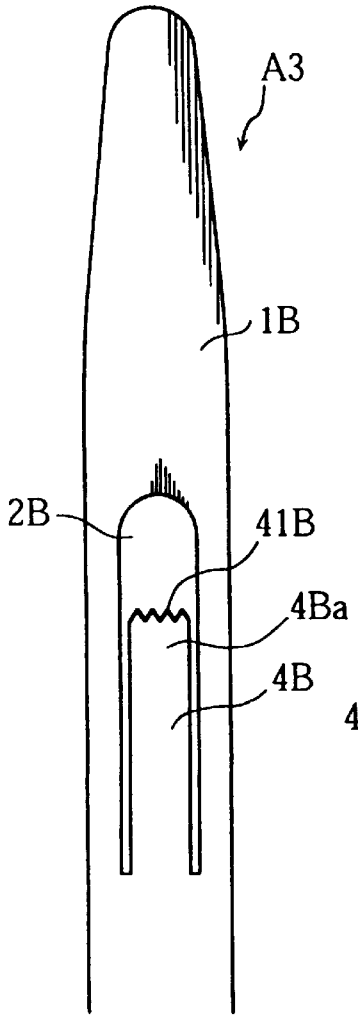
FIG. 13*a* is a fragmentary plan view showing a principal portion of a loop turner according to a third embodiment of the present invention.

FIG. 13*a* illustrates a loop turner A3 according to a third embodiment of the present invention. Again, the loop turner A3 of this embodiment includes a bar body 1B with a loop holding cutout 2B and a clip segment 4B. The clip segment 4B has a free end 4B*a* formed with a toothed portion 41B. The loop turner A3 of the third embodiment is otherwise similar to that of the first embodiment.

According to the third embodiment, the toothed portion 41B at the free end 4B*a* of the clip segment 4B engages the first end 5*a* of the loop member 5 at the time of turning inside out (see FIGS. 7 and 8). Thus, the first end 5*a* of the loop member 5 can be reliably prevented from unexpectedly slipping off the clip segment 4B.

Figure 13B:
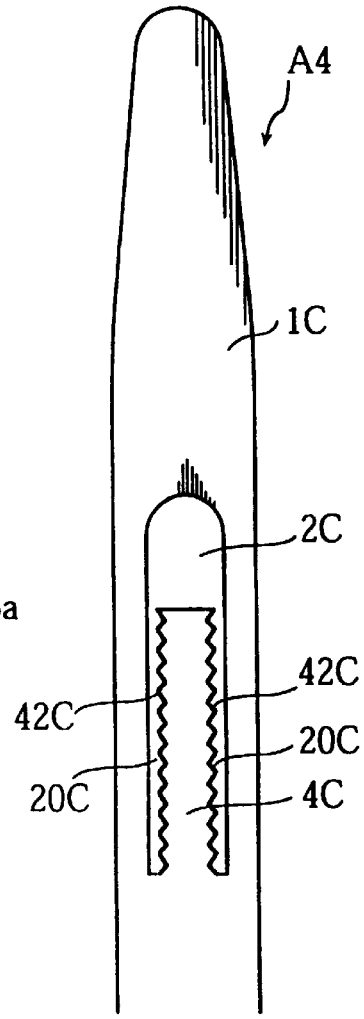
FIG. 13*b* is a fragmentary plan view showing a principal portion of a loop turner according to a fourth embodiment of the present invention.

FIG. 13*b* illustrates a loop turner A4 according to a fourth embodiment of the present invention. Again, the loop turner A4 of this embodiment includes a bar body 1C with a loop holding cutout 2C and a clip segment 4C. The clip segment 4C has a pair of toothed side edges 42C each adjoining a complimentarily configured slit 20C. The loop turner A4 of the fourth embodiment is otherwise similar to that of the first embodiment.

According to the fourth embodiment, the toothed side edges 42C of the clip segment 4C engage the first end 5*a* of the loop member 5 at the time of turning inside out (see FIGS. 5, 7 and 8). Thus, the first end 5*a* of the loop member 5 can be reliably prevented from unexpectedly slipping off the clip segment 4C.

Figure 13C:
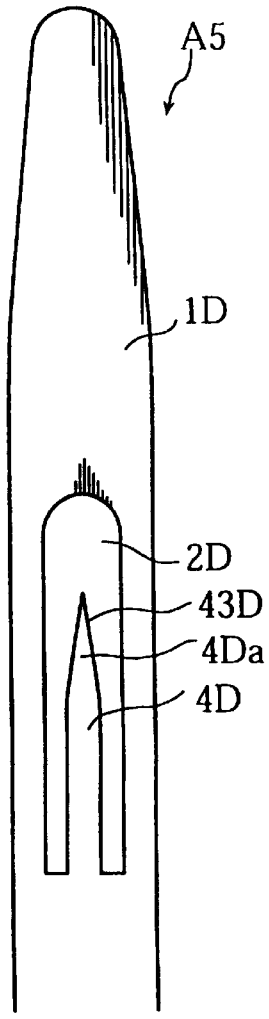
FIG. 13*c* is a fragmentary plan view showing a principal portion of a loop turner according to a fifth embodiment of the present invention.

FIG. 13*c* illustrates a loop turner A5 according to a fifth embodiment of the present invention. Again, the loop turner A5 of this embodiment includes a bar body 1D with a loop holding cutout 2D and a clip segment 4D. The clip segment 4D has a free end 4D*a* formed with a sharpened tip 43D. The loop turner A5 of the fifth embodiment is otherwise similar to that of the first embodiment.

According to the fifth embodiment, the sharpened tip 43D at the free end 4D*a* of the clip segment 4D engages the first end 5*a* of the loop member 5 at the time of turning inside out (see FIGS. 7 and 8). Thus, the first end 5*a* of the loop member 5 can be reliably prevented from unexpectedly slipping off the clip segment 4D.

In either of the first to fifth embodiments described above, a relatively large space is provided ahead of the clip segment 4 (or 4A–4D) by the loop holding cutout 2 (or 2A–2D). However, the loop holding cutout 2 may be formed in a manner such that the clip segment is surrounded only by narrow slits like the slits 20 shown in FIG. 1. Further, the bar body 1 (or 1A–1D) may be made of a material (e.g. metal) other than a synthetic resin.

Figure 14:
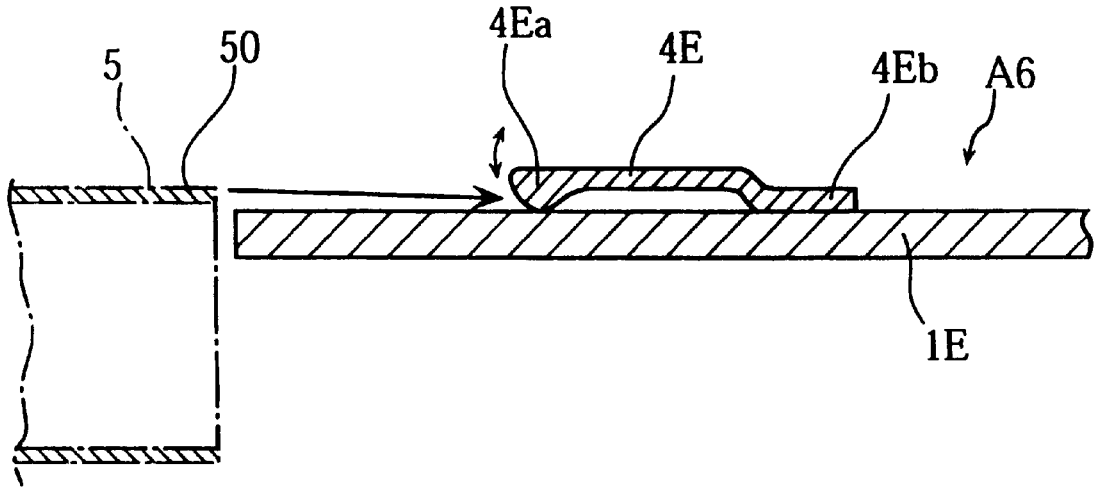
FIG. 14 is a fragmentary view, in longitudinal section, showing a principal portion of a loop turner according to a sixth embodiment of the present invention.

FIG. 14 illustrates a loop turner A6 according to a sixth embodiment of the present invention. The loop turner A6 of this embodiment includes a bar body 1E with a separate clip segment 4E but without any loop holding cutout. The clip segment 4E, which resembles the arrow clip of a fountain pen, has a free end 4E*a* and a base end 4E*b* fixed to the bar body A6. The loop turner A6 of the sixth embodiment is otherwise similar to that of the first embodiment.

According to the sixth embodiment, the clip segment 4E is elastically deformable for engagement with the open mouth edge 50 of the loop member 5 at the time of inserting the bar body 1E into the loop member 5. The clip segment 4E may be made integral with the bar body 1E. Further, the clip segment 4E may be made of a resin or metal while the bar body 1E may be also made of a resin or metal.

Figure 15:
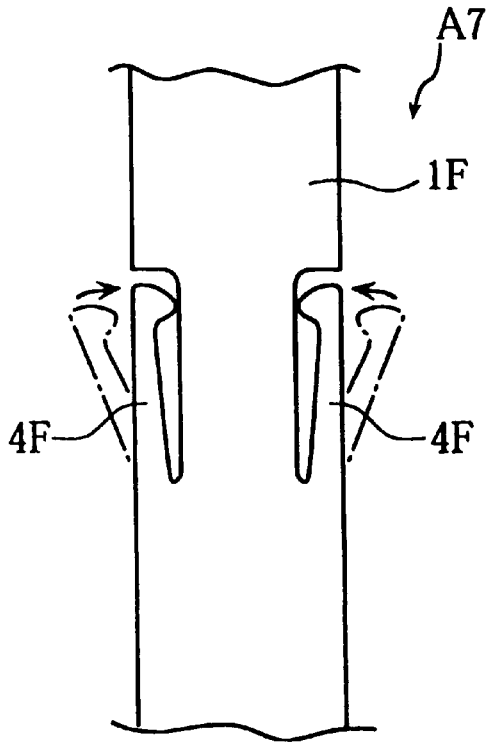
FIG. 15 is a fragmentary plan view showing a principal portion of a loop turner according to a seventh embodiment of the present invention.

FIG. 15 illustrates a loop turner A7 according to a seventh embodiment of the present invention. The loop turner A7 of this embodiment includes a bar body 1F with a pair of side clip segments 4F but without any loop holding cutout. The loop turner A7 of the seventh embodiment is otherwise similar to that of the first embodiment.

According to the seventh embodiment, each of the side clip segments 4F is elastically deformable laterally of the bar body 1F for engagement with the open mouth edge 50 of the loop member 5 (see FIG. 2) when inserting the bar body 1F into the loop member 5. Each of the side clip segments 4F may be prepared separately from the bar body 1F and later attached thereto.

Figure 16A:
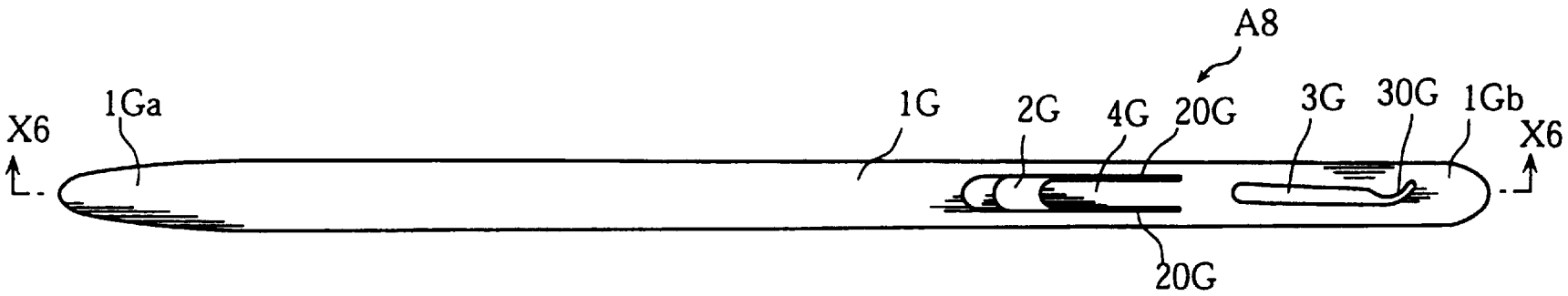
FIG. 16*a* is a plan view showing a loop turner according to an eighth embodiment of the present invention.
Figure 16B:
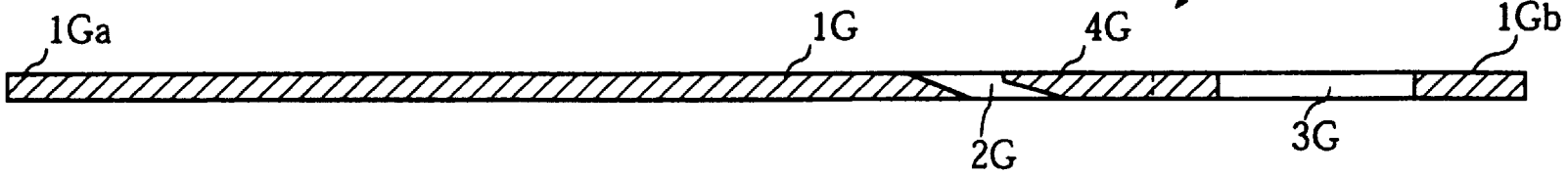
FIG. 16*b* is a sectional view taken along section lines X6—X6 in FIG. 16*a;*

FIGS. 16*a* and 16*b* a loop turner A8 according to an eighth embodiment of the present invention. The loop turner A8 of this embodiment includes a bar body 1G with a front end 1G*a* and a rear end 1G*b*, a loop holding cutout 2G with a pair of slits 20G, a string holding cutout 3G with a curved narrower end portion 30G, and a clip segment 4G formed at the the loop holding cutout 2G. These elements are basically similar in configuration to those of the first embodiment. The only difference between the first and eighth embodiments resides in that the loop holding cutout 2G, the string holding cutout 3 and the clip segment 4G are disposed offset toward (i.e., adjacent to) the rear end 1G*b* of the bar body 1G.

Figure 17A:
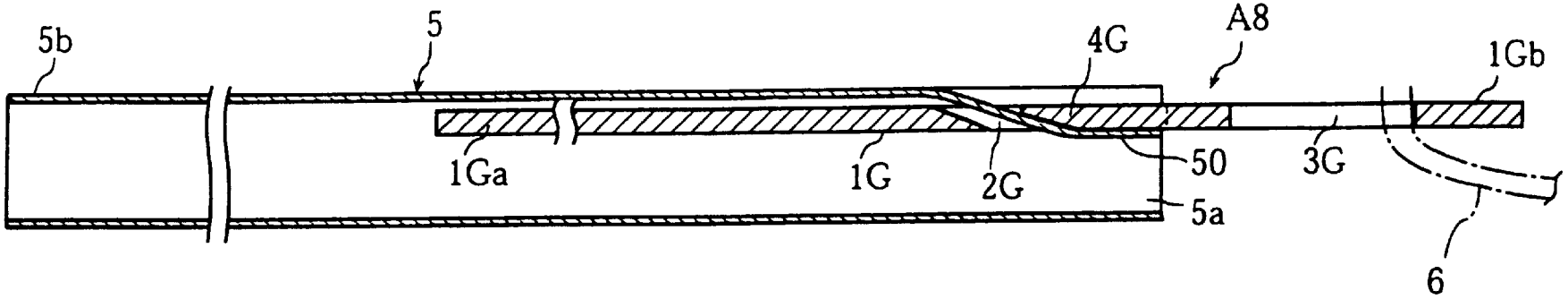
FIGS. 17*a* and 17*b* are longitudinal sectional views showing how to use the loop turner of FIGS. 16*a* and 16*b* for turning a loop member inside out.
Figure 17B:
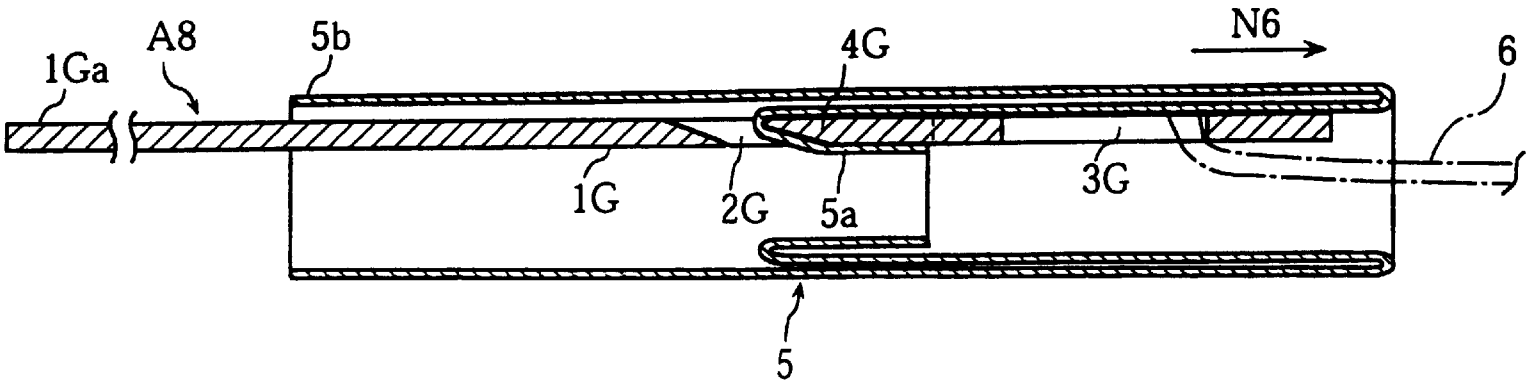
Figure 18:
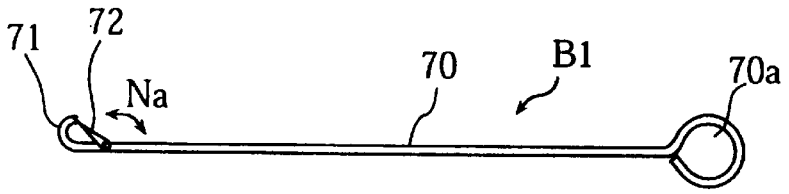
FIG.18 Prior Art
FIG. 18 is a side view showing a prior art loop turner.
Figure 19:
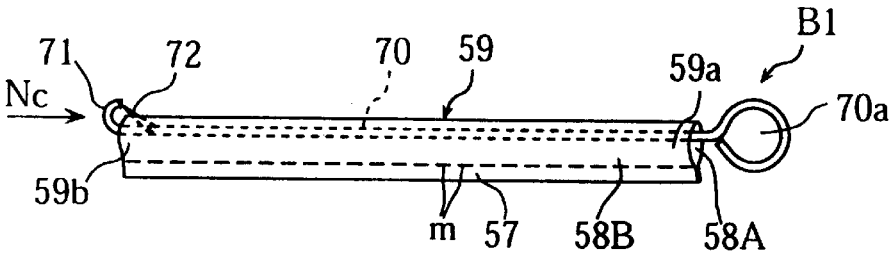
FIG.19 Prior Art
FIGS. 19 and 20 are side views showing how to use the prior art loop turner for turning a loop member inside out.
Figure 20:
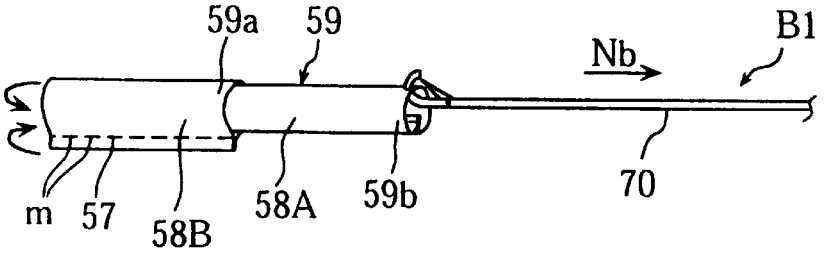
FIG.20 Prior Art
Figure 21:
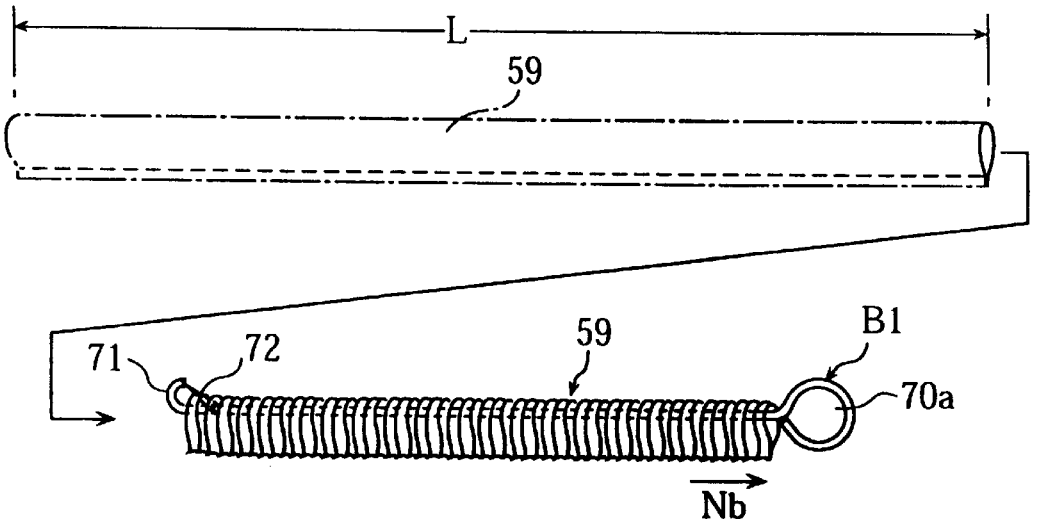
FIG.21 Prior Art
FIG. 21 is a side view illustrating one of the problems encountered in using the prior art loop turner.

In use of the loop turner A8 of the eighth embodiment, the bar body 1G is inserted deeply into the loop member 5 for bringing the clip segment 4G into clamping engagement with the open mouth edge 50 of the loop member 5 at the first end 5*a* thereof, as shown in FIG. 17*a*. Then, the loop member 5 is turned inside out by relatively moving the second end 5*b* of the loop member 5 toward the rear end 1G*b* of the bar body 1G, as indicated by an arrow N6 in FIG. 17*b*. At this time, the bar body 1G having been deeply inserted into the loop member 5 serves as a support core for facilitating the step of turning the loop member 5 inside out. Further, a string 6 may be passed through the loop member 5 simultaneously with turning the loop member 5 inside out if the string holding cutout 3G is previously made to retain the string 6.

As can be appreciated from the description of the first and eighth embodiments, the loop holding cutout 2 (or 2G), the string holding cutout 3 (or 3G) and the clip segment 4 (or 4G) may be disposed closer to the front end 1*a* (or 1G*a*) of the bar body 1 (or 1G) or closer to the rear end 1*b* (or 1G*b*) of the bar body 1 (or 1G). Alternatively, these elements may be disposed generally at the center between the front and rear ends of the bar body.

The present invention being thus described, it is obvious that the same may be varied in many other ways. For instance, the string holding cutout may be replaced by a clip segment or any other retaining element for removably holding a reinforcing string. Further, the loop member to be turned inside out by the loop turner may be made of any flexible material other than a fabric. Such variations are not to be regarded as a departure from the spirit and scope of the invention, and all such variations as would be obvious to those skilled in the art are intended to be included within the scope of the following claims.

I claim:

1. A loop turner for turning a loop member inside out, the loop member including an open mouth edge for allowing insertion of the loop turner, the loop turner comprising:

a bar body having a front end and a rear end;

a loop retaining means provided on the bar body for coming into removable engagement with the open mouth edge portion of the loop member at the time of inserting the bar body in one direction through the open mouth edge the loop retaining means including an elastically deformable clip segment having a free end and a base end fixed to the bar body, the free end being toward said one direction relative to the base end, the free end of the clip segment having a rounded tip to provide a non-piercing guide for the open mouth edge portion of the loop member, the loop retaining means further including a loop holding cutout and means for holding within the loop holding cutout said loop member between the clip segment and the bar body; and a string holder provided on the bar body for removably holding a reinforcing string which is inserted through the loop member simultaneously while the loop member is turned inside out, the string holder holding the reinforcing string independently of the loop retainer, the string holder including a cutout having a wider slot portion for string insertion and a curved narrower end portion for string retaining.

2. The loop turner according to claim 1, wherein the string holder comprises a string holding cutout formed in the bar body between the loop retaining means and the rear end of the bar body.

* * * * *